US007393295B1

(12) United States Patent
Futtere

(10) Patent No.: US 7,393,295 B1
(45) Date of Patent: Jul. 1, 2008

(54) BROAD HEAD BLADE AND AIR FLOW EQUALIZER APPARATUS AND METHOD

(76) Inventor: Matthew Futtere, P.O. Box 806, Liberty Hill, TX (US) 78642

( * ) Notice: Subject to any disclaimer, the term of this patent is extended or adjusted under 35 U.S.C. 154(b) by 485 days.

(21) Appl. No.: 10/745,389

(22) Filed: Dec. 23, 2003

Related U.S. Application Data

(60) Provisional application No. 60/446,719, filed on Feb. 11, 2003.

(51) Int. Cl.
*F42B 6/08* (2006.01)

(52) U.S. Cl. ..... 473/583

(58) Field of Classification Search ..... 473/578, 473/582, 583, 584; 30/151, 539, 540
See application file for complete search history.

(56) References Cited

U.S. PATENT DOCUMENTS

| | | | | |
|---|---|---|---|---|
| 1,835,583 | A * | 12/1931 | Altenbach | 132/76.2 |
| 2,528,059 | A * | 10/1950 | Kendrick | 30/151 |
| 2,901,823 | A * | 9/1959 | Widen | 30/151 |
| 3,576,071 | A * | 4/1971 | Eriksen | 30/540 |
| 3,672,677 | A * | 6/1972 | Moore | 473/578 |
| 4,203,601 | A * | 5/1980 | Simo | 473/583 |
| 5,064,202 | A * | 11/1991 | Barner | 473/583 |
| 5,095,621 | A * | 3/1992 | Rapp | 30/539 |
| 6,203,456 | B1 * | 3/2001 | Ossege | 473/578 |
| 6,280,840 | B1 * | 8/2001 | Luhmann et al. | 428/343 |

* cited by examiner

*Primary Examiner*—John Ricci
(74) *Attorney, Agent, or Firm*—J. Nevin Shaffer, Jr.

(57) ABSTRACT

A broad head blade and airflow equalizer apparatus and method includes an extended blade attached to an object and an aerodynamic casing with a first side and a second side. A connection is provided on the first side for connecting the aerodynamic casing to the extended blade such that the aerodynamic casing at least partially covers the extended blade.

20 Claims, 4 Drawing Sheets

BROAD HEAD BLADE AND AIR FLOW EQUALIZER APPARATUS AND METHOD

CROSS REFERENCE TO RELATED PROVISIONAL APPLICATION

This non-provisional patent application is related to provisional patent application No. 60/446,719 filed on Feb. 11, 2003. Applicant hereby claims the benefit of the related provisional application and the entire provisional application is incorporated herein by reference.

TECHNICAL FIELD

This invention relates to a broad head blade and air flow equalizer apparatus and method. In particular, this invention relates to a broad head blade and air flow equalizer apparatus and method for use with arrows with at least one broad head cutting blade with a cutting edge.

BACKGROUND OF THE INVENTION

Mankind has struggled to understand and control the effects of air flow on an object introduced into the air stream since the beginning of the development of useful tools. Thrown spears, shot arrows, flying planes and golf balls all are affected by the force of the air, as is any object, as it moves through the air.

For example only, and not by way of limitation, a difficulty solved by the Applicant's invention relates to achieving accurate and repeatable arrow flight of wide cutting width fixed blade broad head tipped arrows ("broad heads"). The current standard hunting broad heads are designed with the intention of killing via penetration of the chest cavity. This is a very efficient and humane manner of killing most any animal on the face of the earth. Nonetheless, exceptions exist such as with large game birds. For example only and not by way of limitation, the wild turkey is a difficult game bird. A turkey has disadvantages associated with aiming for the chest area and vital internal organs in this region of the bird's body. To begin with a turkey's vital target area is very small. Further, they do not have a significant volume of blood. Additionally, feathers prevent blood sign from reaching the ground and further aid in coagulation of the blood in the wound channel. Additionally, turkeys can run very fast and/or fly after even a mortally placed shot. In fact, common practice after a broad head strikes the turkey is for the archer to immediately jump up and run after the mortally hit game bird in an attempt to physically prevent its escape. This effort brings a hunter in close contact with razor sharp blades as the bird thrashes about. Additionally, chest shots generate significant waste of edible portions of the bird.

While broad heads are useful hunting tools, they would be even more useful if they could be accurately delivered to an area of the animal, such as to the head/neck region, which would cause instant death. This eliminates all the negative aspects as described when hunting turkeys or other game bird with broad heads meant to hit the chest cavity/body of the bird. Unfortunately, the evolution of the broad head has provided no significant changes in design or shape other than those advantages and efficiencies derived from newer materials and better machining techniques for fixed blade broad heads. With the advent and availability of improved materials, the bow for delivering the arrow has also improved considerably. Compound bows are much more efficient than traditional equipment and result in the capability to launch arrows at considerably higher velocities. Unfortunately, these higher velocities introduce significant aerodynamic problems in maintaining accurate arrow flight with a broad head attached. This unwanted resultant inaccurate arrow flight has been termed "steering effect". Prior art attempts to minimize this steering effect have taken two directions.

Currently, one solution is to stay with the traditional two, three, four or more blades rigidly affixed to the ferrule. Here, attempts to minimize the steering effect on larger diameter cutting width broad heads have focused on reducing the surface area of fixed blades in two manners. First, the blades overall cutting width has been reduced to maintain as narrow an aerodynamic profile as possible. In this case the blades are swept back from the tip like wings on a fighter aircraft. Additionally, cut outs within the blade were implemented. Currently, minimum cutting widths of no less than seven-eights of an inch are permitted. Generally acceptable flight is achieved at these widths. However, the steering effect is exacerbated with increasing arrow velocities achieved with today's modern bows. Even a narrow width, swept back, blade can cause trouble in achieving repeatable accurate arrow flights due to pressure exerted by the air, up drafts, down drafts or wind as the arrow flies to its intended target.

A second prior art "solution" to eliminate the steering effect problem has been to create a broad head that has its blades closed during flight. Upon contacting the intended target, these broad heads include some form of mechanism that causes the blades to pop open on impact thus exposing lethal cutting surfaces. With no flat surfaced blades exposed during flight, the steering effect is minimized since there are no pressure differences generated on exposed blade surfaces. Several disadvantages of these so-called "mechanical" broad heads exist such as, for example only, reduced penetration of the broad head, structural weakness of the various broad head elements, and inoperability at the critical moment of contact with the game animal. Additionally, much more kinetic energy is required to achieve equal penetration compared to fixed broad head blades.

In short, maintaining strength upon impact, having large cutting widths, achieving good penetration and maintaining accurate arrow flight are the desired characteristics of a hunting arrow tipped with a broad head blade. Modern manufacturing and materials allow simple production of strong broad heads with razor sharp blades to kill with maximum efficiency upon contact with the hunted animal. Flight, however, is the operative word and repeatable accurate flight is the desired goal. The undesirable steering effect on the current broad head blades, however, results in a loss of control in the flight of an arrow that results in poor accuracy.

Aerodynamics is the study of gases in motion. The principal application of aerodynamics is in the design of aircraft and air is the gas with which the science is most concerned. Understanding arrow flight, or the flight of any other object, requires an understanding of how a wing works to lift an airplane. An arrow with a broad head attached is influenced by the same principles as described by Newton's laws as those that describe the function of an airplane wing and the generation of lift.

The shape of the air foil (wing) is a very important part of lift. Most airfoils today have camber, meaning they have curved upper surfaces and flatter lower surfaces. These airfoils generate lift even when the air flow is horizontal (flat). Symmetric airfoils are airfoils wherein the upper and lower surfaces are the same length. The particles of the air stream above and below symmetric airfoils move at the exact same velocity. As a result, no lift is generated by a symmetric airfoil in horizontal flow (flat wings moving straight ahead cannot fly).

In order to generate lift with a symmetric airfoil, the airfoil must be turned (tilted) with respect to the flow of the air, so that the upper surface is "lengthened" and lower surface is "shortened". This tilting against the air flow is called "angle of attack". It has been shown that if the angle of attack is doubled, the lift doubles. In keeping with the above example concerning broad head tipped arrows, this is exactly why broad head tipped arrows are prone to inaccurate flight. The problem is exacerbated with larger cutting surfaces and greater distances from point of release. The most elegant aerodynamic scheme is to obtain a zero lift condition in which a zero angle of attack corresponds to zero coefficient of lift. In the case of an aircraft, lift is desirable. In the case of a broad head tipped arrow, no lift is desired.

Airplanes have a variety of control surfaces utilized during flight to control flight direction. An arrow is simply launched and travels with no additional human intervention to correct its intended flight path in the event of it moving off the desired flight path. Arrows do contain fletching (feathers or plastic vanes) on the rear portion of the arrow in attempts to impart some semblance of in flight control. This is accomplished via primarily drag forces imparted via helical or offset placement of the fletching designed to keep the arrow aligned and on track so as to accurately hit its intended target. It is intended that the fletching overcome any appreciable amount of torque or lift applied to the exposed surfaces of the arrow. Spin is also imparted in combination with the rear drag to overcome any negative influencing aerodynamic factors between the point of release and striking of the target. Yet it is just this spin that also contributes a difference of pressure (generation of lift) to the exposed surfaces of the broad head blades (wing span) immediately upon acceleration of the arrow from the bow. This contributes immediately to inaccurate arrow flight as compared to a target tipped arrow (ie no broad head blades or any blades or "wings" at all). With no movable controls to correct the in-flight steering effect, accuracy of broad head tipped arrows is lost. By applying too much drag to control the broad head tipped arrow from experiencing the steering effect, not enough energy is retained to provide a killing shot at the hunted animal. Further, hunting distance is severely limited, making for an exceptionally more difficult successful hunting experience.

Further, the role of the air resistance must also be considered when examining the path of an object through the air. Air resistance acts to retard the forward travel of an arrow in flight, for example. Just as too much drag at the rear of the arrow adversely affects the arrow's path, too much pressure up front results in the same negative effect. A narrow width bladed broad head has less cross-sectional surface area to compress air as it travels through space. A wide width blade has increased sectional surface area to compress air as it travels through the same given space. Just as pressure differences can cause undesirable lift and unwanted steering effects, this pressure also contributes to rob the arrow of kinetic energy as it uses up more energy crossing the same given distance. Loss of velocity translates to a less flat trajectory given the arrow travels the same distance as a narrow width broad head. A flat trajectory is important in a hunting situation where an estimation of distance to the target animal adds error to the dynamics of an accurately placed lethal shot. A flatter trajectory allows for a larger margin of human error in achieving an accurately placed shot.

Considering the effect of lift, torque and pressure, it is easy to understand why it is possible to achieve repeatable and accurate flight of a target tipped arrow (no wings) versus the less accurate flight due to steering effects with a broad head tipped arrow (wings) shot from the same bow given all other factors being equal. In both cases, at the moment of transfer of the kinetic energy stored in the limbs of the bow to the movement of the arrow from rest to some given velocity, the shaft flexes in response to this absorption and transfer of energy. With the streamlined shape of the standard target tipped arrow, with no planner surfaces to leverage against, coupled with the minimal frontal arrow surface area to compress and deflect air of any appreciable magnitude in a concerted direction, minimal lift is created thus providing minimal deflection of the target tipped arrow from its intended path. As a result, accurate arrow flight is achieved quite easily due to the minimal impact of lift, torque and pressure on the intended flight path of a target tipped arrow.

On the other hand, in the case of the broad head tipped arrow, it is easy to understand why it experiences unwanted steering effect. Again, at the moment of transfer of the kinetic energy stored in the limbs of the bow to the movement of the arrow from rest to some given velocity, the shaft flexes in response to this absorption. In this case however, this deflection immediately changes the angle of attack of the broad head blade surfaces from the desired zero angle of attack to some greater value. The combination of the forward velocity of the arrow passing through the medium of the air, its changing angles of attack due to each oscillation of the arrow shaft as it travels away from the bow, rotation of the broad head blades creating pressure differences on each side of the blades, and lift created in differing amounts, all cause the adverse steering effects on the broad head tipped arrow. When other contributing factors such as updrafts, downdrafts, and cross winds are coupled with this steering effect on broad head tipped arrows, the magnitude of deflection from the intended target is further amplified and even more chaotic resulting in a greater degree of inaccuracy and less likelihood of repeatedly striking a target in the same place.

SUMMARY OF THE INVENTION

The broad head blade and airflow equalizer apparatus and method of the present invention includes an extended blade attached to an object and an aerodynamic casing with a first side and a second side. A connection is provided on the first side for connecting the aerodynamic casing to the extended blade such that the aerodynamic casing covers at least a portion of the extended blade.

According to one embodiment, the aerodynamic casing further comprises a thin rigid casing conformed to maintain shape as the aerodynamic casing moves through a gas.

According to another embodiment, in a broad head arrow with a shaft and at least one cutting blade, a broad head blade and air flow equalizer includes an aerodynamic casing with a first and second side wherein the first side of the aerodynamic casing at least partially covers the at least one cutting blade. A connection is provided on the aerodynamic casing for connecting the aerodynamic casing to the at least one cutting blade on the broad head arrow. The at least one cutting blade includes a cutting edge extended from and perpendicular to the arrow shaft. According to another embodiment, the generally aerodynamic casing further comprises a thin, rigid casing conformed to maintain shape as the aerodynamic casing moves through an air mass. According to another embodiment, the aerodynamic casing is thin enough to be cut through by the at least one cutting blade upon impact of the broad head arrow and the at least one cutting blade with an object.

BRIEF DESCRIPTION OF THE DRAWINGS

Other objects, features and advantages of the present invention will become more fully apparent from the following detailed description of the preferred embodiment and the accompanying drawings in which.

DETAILED DESCRIPTION OF THE INVENTION

Figure 1:
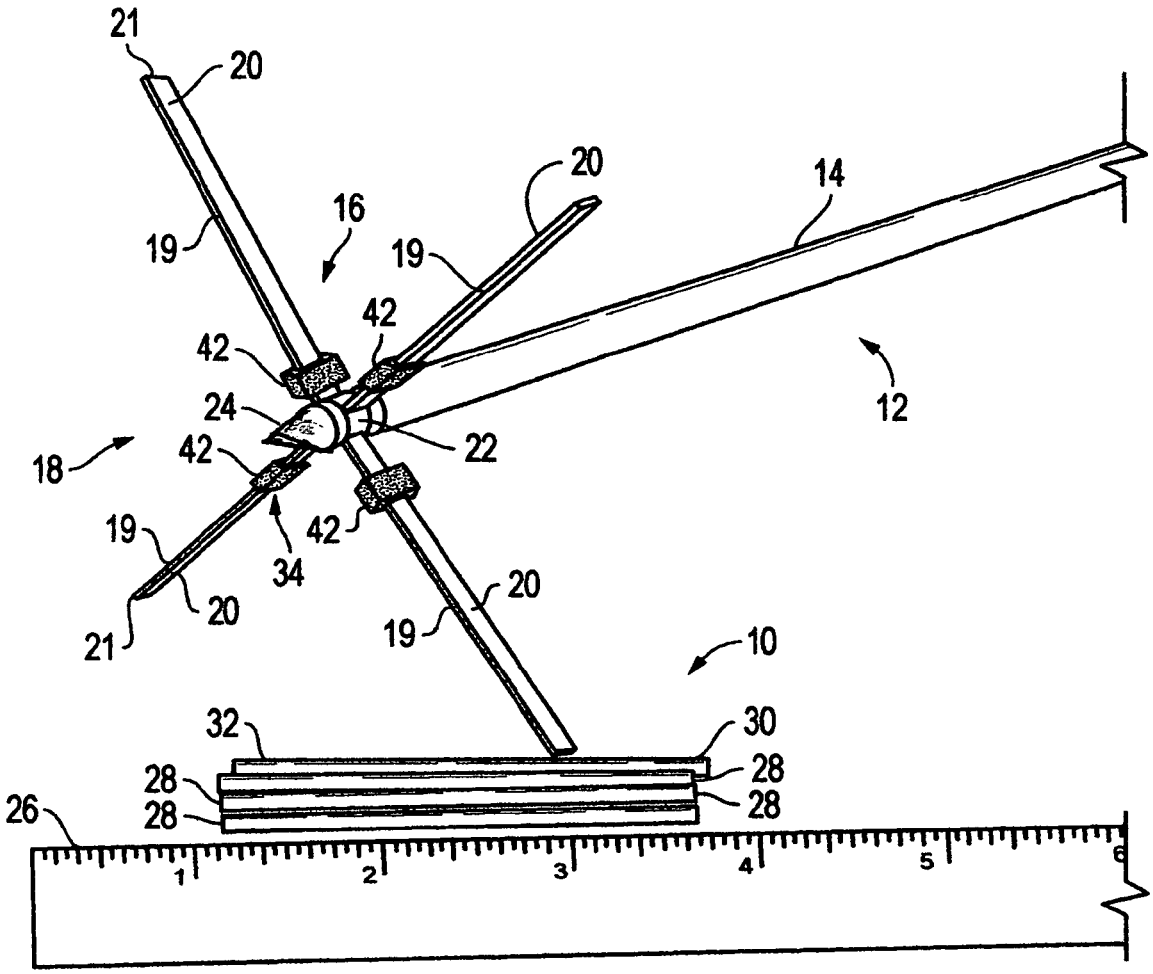
FIG. 1 is a plan view of a four bladed broad head arrow according to an embodiment of the invention with the airflow equalizer apparatus nearby.
Figure 2:
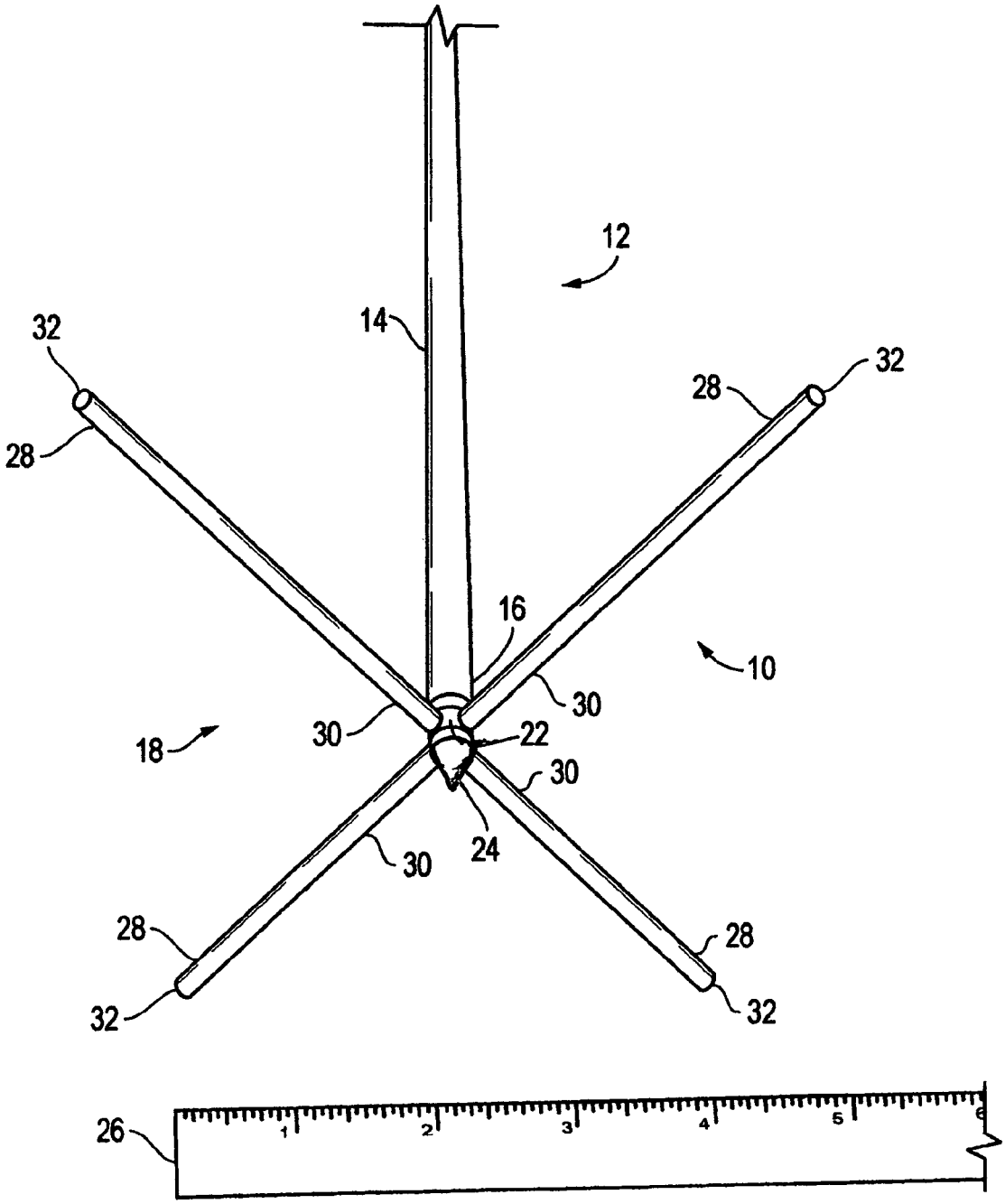
FIG. 2 is a plan view of the four bladed broad head arrow of FIG. 1 with the airflow equalizer apparatus of the present invention in place over each of the broad head arrow blades.

An embodiment of the present invention is illustrated by way of example in FIGS. 1-4. With specific reference to FIGS. 1 and 2, broad head arrow and air flow equalizer 10 is illustrated. FIGS. 1 and 2 show a broad head tipped arrow 12. The broad head tipped arrow 12 includes ferrule/shaft 14 with front end 16. The ferrule/shaft 14 also includes a rear end with fletching and other standard parts of an arrow 12 (not shown). Attached to front end 16 of broad head tipped arrow 12 is a four bladed broad head 18 according to the present invention. Applicant's unique four bladed broad head 18 includes four cutting blades 20 attached to a front end connector 22. Front end connector 22 may include a penetrating point 24. Front end connector 22 is attached to front end 16 of broad head tipped arrow 12, as is known in the art. For ease in determining the typical dimensions of Applicant's broad head tipped arrow 12, a ruler of 26 is included in the illustration. Applicant's cutting blade 20, according to one aspect of the invention, is generally an extended, rectangular shape and extends, according to one aspect of the invention, in a uniform manner from the front end connector 22 generally perpendicularly from shaft 14. As a result, a very much wider cutting area is thereby provided than is possible with the swept back cutting blades known in the art. Problematically however, as discussed, above, these cutting blades 20, by themselves, are subject to extreme adverse steering effects as will be more fully discussed hereafter.

According to another aspect of the invention, the cutting blade 20 changes dimension from the attachment at the shaft 14 to the extended end 21. As shown in FIG. 1, in this aspect of the invention, cutting blade 20 tapers along some portion of its length toward the extended end 21.

FIGS. 1 and 2 illustrate the principle of operation of the broad head blade and air flow equalizer 10 that overcomes the adverse steering effects on Applicant's unique broad head cutting blade 20 as well as any other cutting blades and objects introduced into a wind stream. The Applicant's broad head blade and air flow equalizer 10 includes an aerodynamic casing 28. Aerodynamic casing 28 includes a first end 30 and a second end 32. Aerodynamic casing 28, according to one embodiment, is a hollow, thin, rigid sleeve. Further, according to this embodiment, aerodynamic casing 28 is generally formed in a circular shape. Still further, aerodynamic casing 28 is rigid enough to maintain its shape, whatever that may be, after being introduced into an air mass. Aerodynamic casing 28 is created from any suitable thin, rigid, material such as plastic, or the like, now known or hereafter developed. Importantly, aerodynamic casing 28 must be rigid enough, again, to maintain its form while attached to the cutting blades 20 during and after the time the broad head tipped arrow 12 is launched from a bow into an air mass. Any material that meets this requirement, now known or hereafter developed, is suitable for the purposes of this invention.

FIG. 1 illustrates broad head blade and air flow equalizer 10 in the detached position prior to connection of the aerodynamic casing 28 to the broad head tipped arrow 12. FIG. 2 illustrates aerodynamic casing 28 in position over extended cutting blades 20 on broad head tipped arrow 12. In the position illustrated in FIG. 2, aerodynamic casing 28 substantially covers and encases cutting blades 20. According to one embodiment, aerodynamic casing 28 encompasses cutting blades 20 by passing first end 30 of aerodynamic casing 28 over the extended end 21 of cutting blade 20. Thereafter, aerodynamic casing 28 is retained in position on cutting blades 20 by means of connector 34.

In one embodiment, as shown in FIGS. 1 and 3, the mechanism for attaching each aerodynamic casing 28 in place over cutting blades 20 is via foam tape 42 that is sticky on both sides. One small piece is placed on either side of each of the cutting blades 20 near the point of attachment of the cutting blade 20 to the ferrule 14. The first end 30 of aerodynamic casing 28 is then slid over the extended end 21 of cutting blade 20 until it is flush with the ferrule 14 and substantially covers the cutting blade 20 and the pieces of foam tape 42. The foam tape 42 while adhering to the cutting blade 20 also adheres to the inner diameter of the aerodynamic casing 28. This holds aerodynamic casing 28 in place with enough force to maintain adherence despite experiencing the forces of aerodynamic pressures during flight as discussed above. Foam tape 42 is very durable, simple to use and adds no appreciable mass to the broad head arrow 12 when completely assembled and ready for hunting. The foam thickness allows the aerodynamic casing 28 to expand back to its original shape and dimension at point of adhesion after compression, as shown in FIG. 4, and to establish good points of contact adhesion. Preferably, the foam tape 42 size is slightly smaller than the width of the cutting blade 20 and approximately ¼ inch long. Preferably, two pieces of foam tape 42 are used to attach aerodynamic casing 28 to each of the four cutting blades 20. Any type of light weight double sided sticky tape, or glue, putty or the like, now known or hereafter developed is suitable for the purposes of the invention.

According to another embodiment of the invention, aerodynamic casing 28 is a thin, casing that, in addition to being rigid enough to maintain its shape after application to the cutting blades 20, is easily cut through by cutting blades 20 upon impact of the broad head tipped arrow 12 with an object. Again, any material that is sufficiently rigid, yet thin, such as plastic, for example only, is appropriate for the purposes of this invention.

Figure 3A:
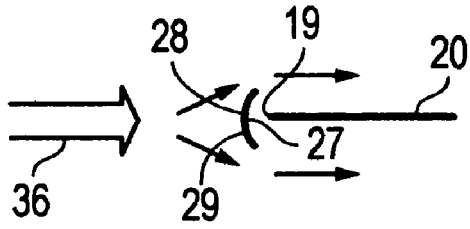
FIG. 3A is a side view of a minimal airflow equalizer connected to and partially covering a blade.
Figure 3B:
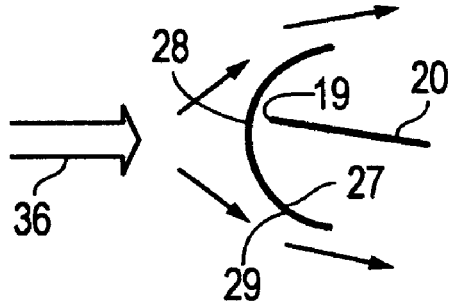
FIG. 3B is a side view of a larger airflow equalizer connected to and covering more of a blade.
Figure 3C:
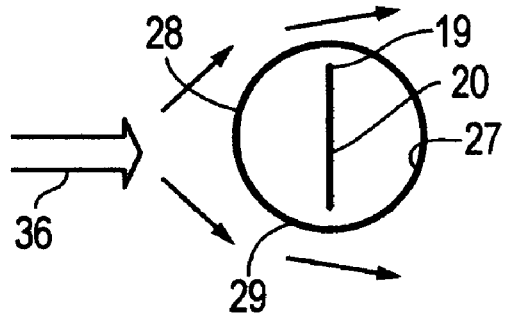
FIG. 3C is a side view of an airflow equalizer that substantially encompasses all of a blade.
Figure 4:
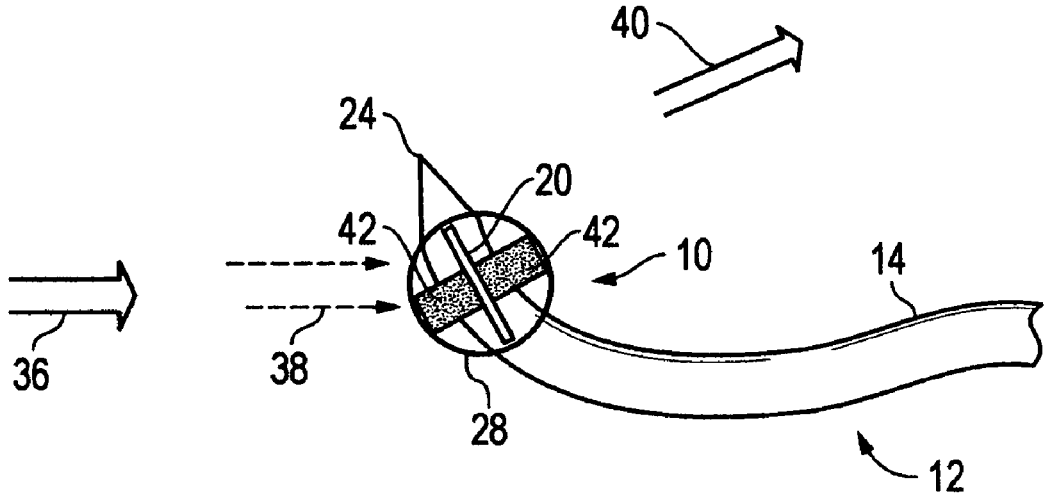
FIG. 4 is a side view of the airflow equalizer apparatus attached to a broad head tipped arrow blade after the arrow has been introduced into the air mass.

Referring now to FIGS. 3A, 3B and 3C other aspects of the invention are discussed. It may be for purposes of economy, or any other reason, that only the leading or cutting edge 19 of cutting blades 20 are protected by aerodynamic casing 28. That is, in circumstances wherein only minimal oscillation of cutting blade 20 occurs only a relatively small portion of cutting blade 20 need be protected. Referring to FIG. 3C, it is illustrated that in situations in which blade 20 does not oscillate much, aerodynamic casing 28 need only partially cover blade 20. FIG. 3B illustrates that in situations of larger blade 20 oscillations, more surface area of blade 20 must be protected thus requiring more of aerodynamic casing 28. FIG. 3C illustrates the situation of extreme oscillation wherein aerodynamic casing 28 substantially fully encompasses blade 20. FIGS. 3A,B and C show first side 27 of aerodynamic casing 28 connected as described above to blade 20 and second side 29 facing air flow direction arrows 36. As illustrated, it can be understood that a complete tubular casing that encircles and encompasses the blade 20 is not needed or required in every situation. In many instances, some or all of the trailing portion of the aerodynamic casing 28 may be cut out.

Referring now to FIG. 4, the operation of the broad head blade and air flow equalizer 10 is further illustrated. Direction arrow 36 illustrates the direction of relative and/or actual airflow in relation to broad head tipped arrow 12. Broad head tipped arrow 12, as illustrated in FIG. 4, is shown in an exaggerated deflected form wherein the shaft 14 has been bent/deflected as a result of the transfer of energy from a bow (not shown) to broad head arrow 12 upon launching the broad head tipped arrow 12 from the bow. While broad head tipped arrow 12 is generally moving in the direction opposite to airflow direction arrow 36, as previously discussed, the shaft 14 and connected parts of broad head tipped arrow 12 oscillate up and down as they move through the air mass. Dotted lines and direction arrows 38 indicate where relative/actual airflow 36 would normally impact cutting blades 20. Normally, as a result of the airflow shown by direction arrows 38, broad head tipped arrow 12 would be deflected from its intended path in the direction generally of direction arrow 40. As previously discussed, the presence of the extended cutting blades 20 on broad head tipped arrow 12 results in unwanted steering effects causing the arrow 12 to move from its intended path to an unintended path in the direction of direction arrow 40, for example. This is why prior art blades are swept back and do not extend very far from the sides of the arrow shaft 14. Applicants generally perpendicularly extended cutting blades 20 provide a much more preferable wider cutting area but are even more subject to steering forces.

In accordance with the present invention, however, air flow 36 is prevented from contacting Applicant's extended cutting blades 20. Further, aerodynamic casing 28 presents a symmetric air flow form to air flow 36 and prevents air from impacting blades 20. As a result, no unwanted lift, torque, or air pressure is transmitted to the arrow 12 by way of extended broad head cutting blades 20. This is to say, again, that broad head blade and air flow equalizer 10 provides a protective aerodynamic casing 28 that equalizes air flow across the surfaces of aerodynamic casing 28 even with changing angles of attack of the encased broad head cutting blades 20. As a result, regardless of the angle of attack of the cutting blades 20, no change in pressure difference is created and, therefore, no lift is created. For example only, in cases of extreme oscillation, by encasing the flat surface (wings) of extended cutting blades 20 in an aerodynamically redundant shape, aerodynamic casing 28, aerodynamic integrity is maintained such that maximum opportunity is achieved for creating as near a zero coefficient of lift as a possible. This results in repeatable and accurate broad head tipped arrow flight even with Applicant's large width cutting blades 20.

By way of further explanation, broad head blade and air flow equalizer 10 minimizes the effects of changes of the angle of attack on the flat broad head cutting blade 20 surfaces by removing their surfaces from the fluid stream of air they travel through. The aerodynamic casing 28 either partially shields or substantially envelops the broad head cutting blades 20, as the situation warrants, with a lightweight, aerodynamic casing 28 that maintains its shape when facing increased aerodynamic pressures. By not allowing air to cross the surface of the extended cutting blades 20, because of the aerodynamic size and shape of airflow equalizer 10, minimal coefficient of lift is created regardless of uncontrollable changing angles of attack created during normal flight of an arrow 12. As a result, extremely minimal, if any, lift is created that would influence a change in direction from the intended flight path of a broad head tipped arrow 12. As a further result, repeatable and accurate flight of broad head tipped arrows 12 is enabled. As illustrated, the general aerodynamic shape of the aerodynamic casing 28 is perpendicular with respect to the direction of travel of the arrow 12 and its intended target. It should be understood that any aerodynamically redundant shape is included within the scope of the disclosed invention, such as, for example only, a tear drop shape.

Once at the target animal, for example, aerodynamic casing 28 is removed with the absolute minimum loss of kinetic energy thereby allowing for maximum penetration. By way of the present invention, upon impact with the target object/animal, the razor sharp cutting blades 20, cutting edges 19, simply cut through, with minimal resistance, the thin, yet aerodynamically firm, aerodynamic casing 28.

In tests, Applicant has compared a broad head tipped arrow 12 with four uncovered five-inch span cutting blades 20 with a similar broad head tipped arrow 12 utilizing Applicant's aerodynamic casing. In all instances, the uncovered five-inch span broad head tipped arrow 12 did not even reach the intended target. Instead, the uncovered arrow 12 either smashed into the ground or stalled out in the air and tumbled back to the ground due to the cumulative effect of lift created by the extended cutting blades 20 while the arrow 12 attempted to overcome the kinetic energy imparted to it upon launch. To the contrary, a similar broad head tipped arrow 12 utilizing Applicant's extended blades 20 protected by aerodynamic casings 28 resulted in consistently accurate and successful hits on the target at vastly increased distances.

The description of the present embodiments of the invention have been presented for purposes of illustration but are not intended to be exhaustive or to limit the invention to the form disclosed. Many modifications and variations will be apparent to those of ordinary skill in the art. As such, while the present invention has been disclosed in connection with the preferred embodiment thereof, it should be understood that there may be other embodiments which fall within the spirit and scope of the invention as set forth in the following claims.

What is claimed is:

1. A blade and cover apparatus comprising;

a) an extended blade attached to an object with an elongated shaft wherein said extended blade includes a cutting edge and said cutting edge is parallel to said elongated shaft; and b) an aerodynamic casing, wherein the aerodynamic casing is a tubular casing substantially encompassing the extended blade, with a first side and a second side wherein a connection is provided on the first side for connecting the aerodynamic casing to the extended blade such that the aerodynamic casing covers at least a portion of the extended blade and wherein the connection comprises foam tape.

2. The apparatus of claim 1 further comprising a plurality of extended blades.

3. The apparatus of claim 1 wherein the extended blade comprises four approximately equally spaced apart extended blades attached approximately perpendicularly to the object.

4. The apparatus of claim 1 wherein the extended blade extends approximately perpendicularly from the elongated shaft.

5. The apparatus of claim 1 wherein the aerodynamic casing further comprises a thin rigid casing conformed to maintain shape as the aerodynamic casing moves through a gas.

6. The apparatus of claim 1 wherein the aerodynamic casing is a resilient plastic.

7. The apparatus of claim 1 wherein the aerodynamic casing is thin enough to be cut through by the extended blade upon impact of the aerodynamic casing with another object.

8. In a broad head arrow with a shaft and with at least one cutting blade, a broad head blade and air flow equalizer includes:

a) an aerodynamic casing with a first and second side wherein the first side of the aerodynamic casing at least partially covers the at least one cutting blade;

b) a connection provided on the aerodynamic casing for connecting the aerodynamic casing to the at least one cutting blade on the broad head arrow; and c) wherein the at least one cutting blade includes a cutting edge and the cutting edge extends from, and is approximately perpendicular to, the arrow shaft.

9. The apparatus of claim 8 wherein the aerodynamic casing further comprises a thin, rigid casing conformed to maintain shape as the aerodynamic casing moves through an air mass.

10. The apparatus of claim 8 wherein the aerodynamic casing is a hollow plastic sleeve.

11. The apparatus of claim 8 wherein the aerodynamic casing is thin so as to be cut through by the at least one cutting blade upon impact of the broad head arrow and the at least one cutting blade with an object.

12. The apparatus of claim 8 further comprising a plurality of cutting blades.

13. The apparatus of claim 8 further comprising four approximately equally spaced apart cutting blades.

14. The apparatus of claim 8 wherein the connection comprises foam tape.

15. The apparatus of claim 8 further comprising a penetrating point attached to the arrow shaft in front of the at least one cutting blade.

16. The apparatus of claim 8 wherein the at least one cutting blade is an extended rectangular shape with at least one cutting edge.

17. The apparatus of claim 8 wherein the at least one cutting blade has a length and the at least one cutting blade changes dimension along the length.

18. The apparatus of claim 8 wherein the aerodynamic casing is a tubular casing that substantially encompasses the extended blade.

19. In a broad head arrow with a shaft and with at least one cutting blade, a broad head blade and air flow equalizer method includes:

a) providing an aerodynamic casing with a first and second side and attaching the first end of the aerodynamic casing to the at least one cutting blade so that the aerodynamic casing at least partially encompasses the at least one cutting blade when placed on the at least one cutting blade;

b) providing a connection on the aerodynamic casing for connecting the aerodynamic casing to the at least one cutting blade;

c) providing the at least one cutting blade with a cutting edge and attaching the cutting blade to the arrow shaft such that the cutting edge extends from, and is approximately perpendicular to, the arrow shaft; and d) connecting the aerodynamic casing to the at least one cutting blade.

20. The method of claim 19 further comprising providing a plurality of cutting blades.

* * * * *